US005115945A

United States Patent [19]

Ruck

[11] Patent Number: 5,115,945

[45] Date of Patent: May 26, 1992

[54] DISPENSING DEVICE AND A BATHROOM ORGANIZER INCORPORATING SAME

[76] Inventor: Wolf E. Ruck, 1720 Lincolnshire Blvd., Mississauga, Ontario, Canada, L5E 2S7

[21] Appl. No.: 536,478

[22] Filed: Jun. 12, 1990

[51] Int. Cl.[5] ..... B65D 35/54; B65D 83/00

[52] U.S. Cl. ..... 222/96; 222/93; 222/132; 222/135; 222/400.5; 222/401; 222/389; 222/181

[58] Field of Search ..... 222/401, 400.5, 389, 222/387, 386.5, 209, 212, 192, 185, 183, 181, 135, 132, 129, 106, 105, 95, 96, 94, 93

[56] References Cited

U.S. PATENT DOCUMENTS

| | | | |
|---|---|---|---|
| 316,594 | 4/1885 | Adami | 222/185 |
| 2,103,687 | 12/1937 | McKenney | 222/400.5 |
| 2,327,285 | 8/1943 | Opitz | 222/400.5 |
| 2,718,335 | 9/1955 | Shippen | 222/135 |
| 3,078,016 | 2/1963 | Judy | 222/181 |
| 3,130,873 | 4/1964 | Klutz | 222/135 |
| 3,204,823 | 9/1965 | Watson, Jr. | 222/105 |
| 3,349,967 | 10/1967 | Schneller | 222/135 |
| 3,539,081 | 11/1970 | Norton | 222/185 |
| 3,990,611 | 11/1976 | Sojka | 222/135 |
| 4,105,140 | 8/1978 | Roth | 222/192 |
| 4,142,651 | 3/1979 | Leopoldi et al. | 222/185 |
| 4,147,278 | 4/1979 | Uhlig | 222/95 |
| 4,159,790 | 7/1979 | Bailey | 222/386.5 |
| 4,463,876 | 8/1984 | Swallert | 222/185 |
| 4,535,918 | 8/1985 | Heiligman et al. | 222/401 |

FOREIGN PATENT DOCUMENTS

| | | | |
|---|---|---|---|
| 454570 | 2/1949 | Canada | 222/185 |
| 2237518 | 3/1978 | Fed. Rep. of Germany . | |
| 2755112 | 6/1979 | Fed. Rep. of Germany | 222/105 |

*Primary Examiner*—Donald T. Hajec
*Assistant Examiner*—Kenneth Bomberg
*Attorney, Agent, or Firm*—Smart & Biggar

[57] ABSTRACT

A viscous material dispenser (for liquid soap and the like) comprises a piston in fluid communication with an air chamber. Depressing the piston increases the pressure in the air chamber and this pressurized air is conducted through a duct to a reservoir. Depressing the piston also opens a nozzle leading from the bottom of the reservoir. In one embodiment the duct terminates in a portion which turns back on the remainder of the duct which portion incorporates a one-way non-return valve so that the pressure in the reservoir may be built up with consecutive strokes of the piston due to the non-return valve. When air is pumped through the duct, a bubble of air is trapped between the valve and the mouth of the duct which prevents fouling of the valve by the viscous material. In another embodiment, the reservoir may contain a sac of a viscous material; in this embodiment a one-way valve to admit air to the air chamber may be locked closed during a portion of the return stroke of the piston to suck viscous material at the basal dispensing opening of the unit back into the unit thereby preventing drips.

13 Claims, 10 Drawing Sheets

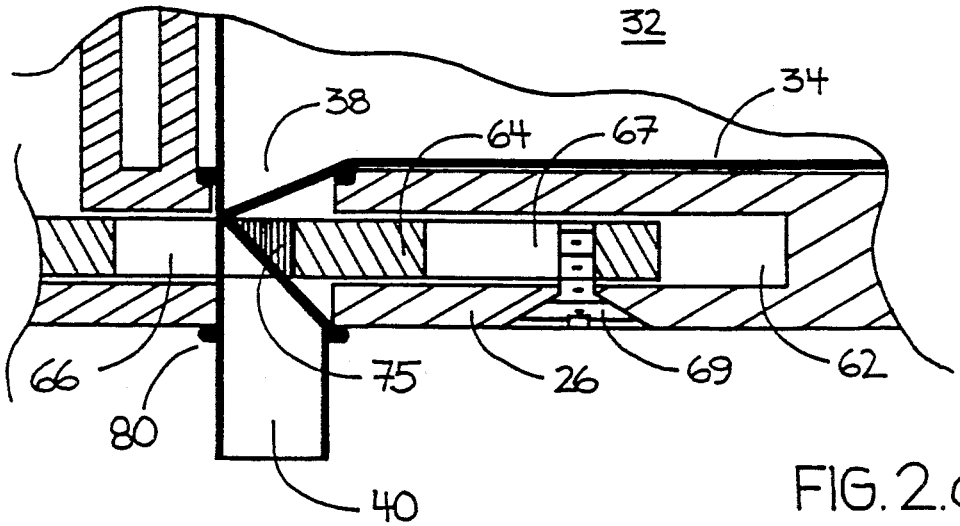
FIG. 2.a.
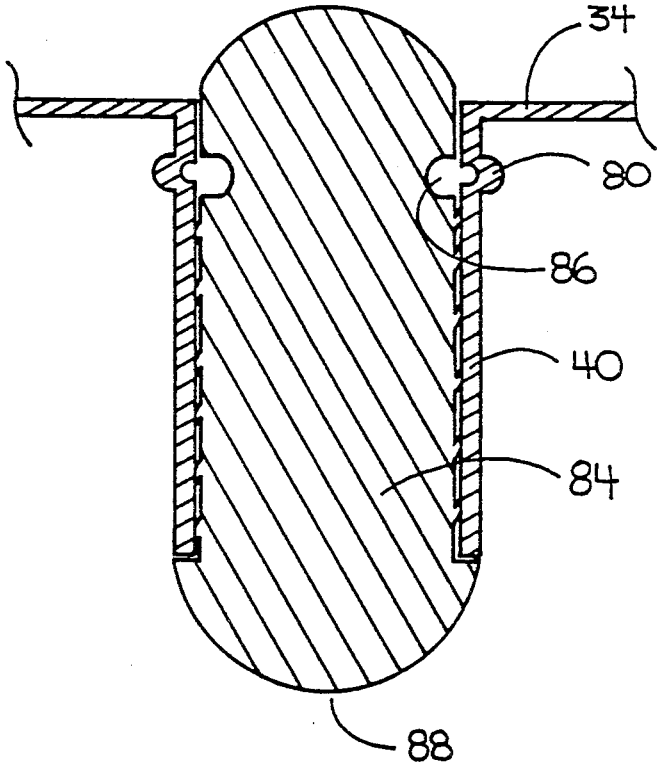
FIG. 2.b.

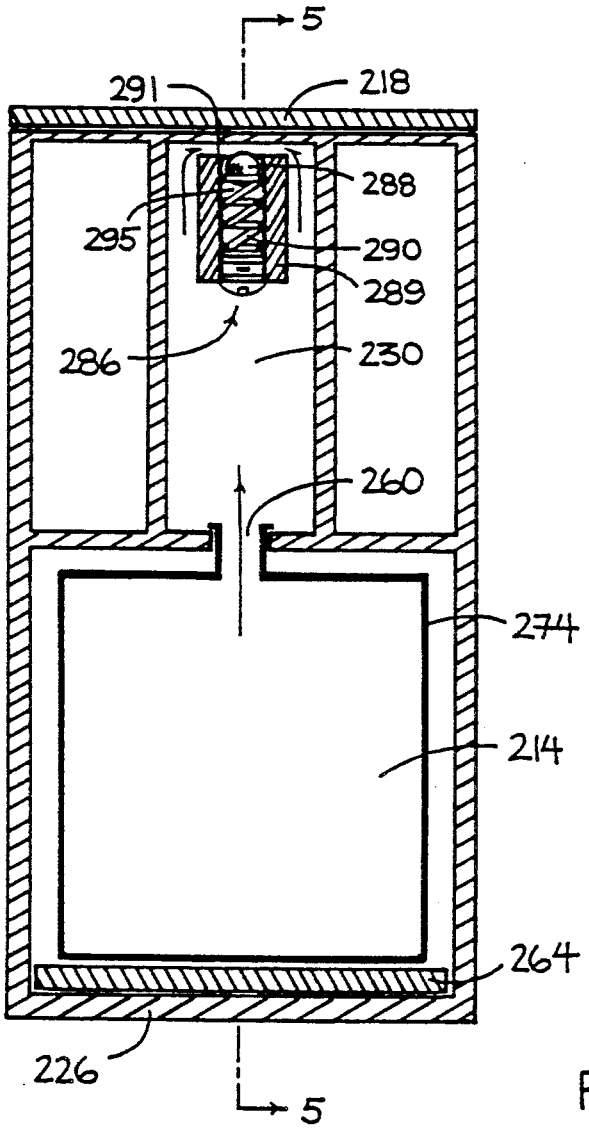
FIG. 5.a.

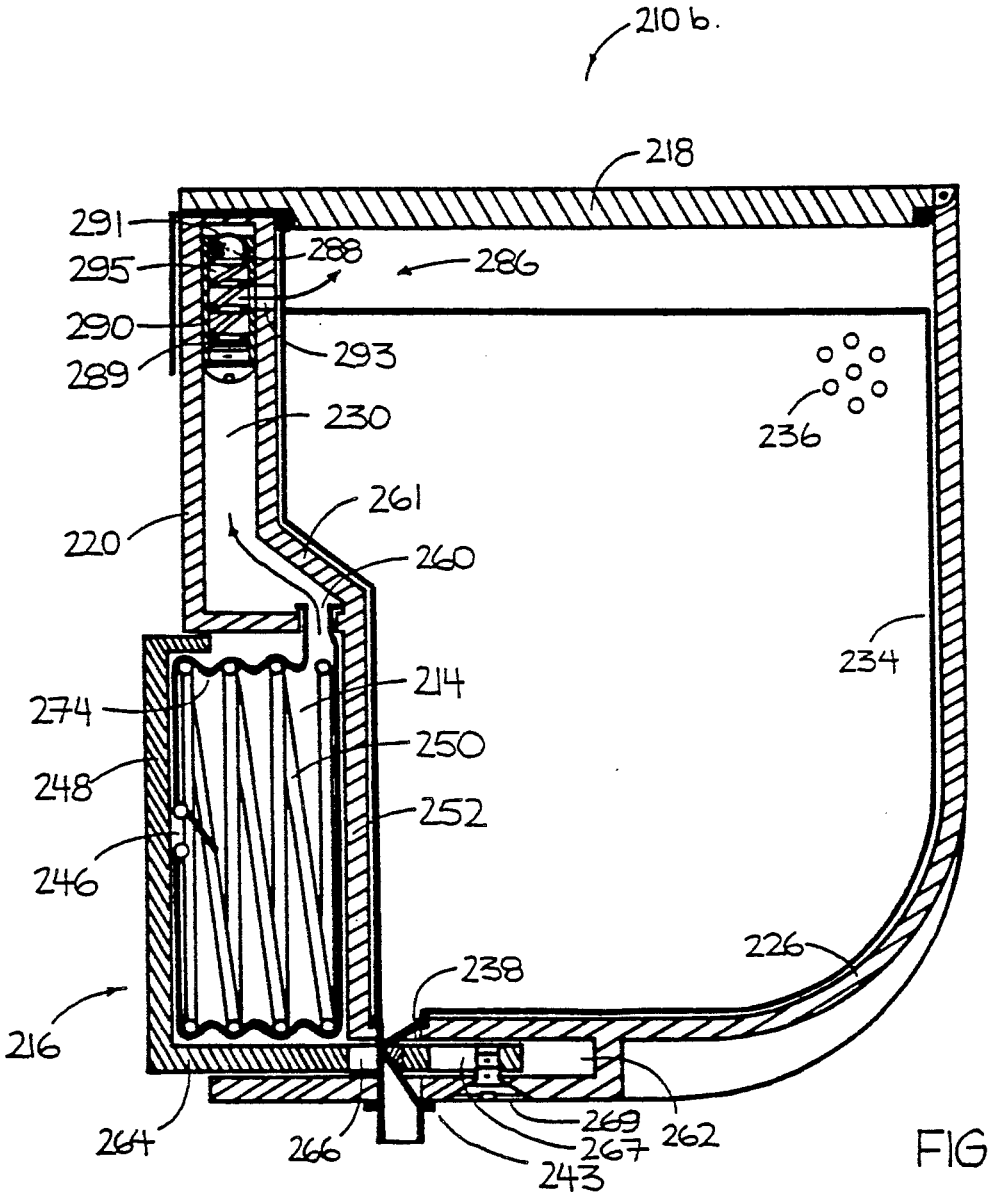
FIG.5.b.

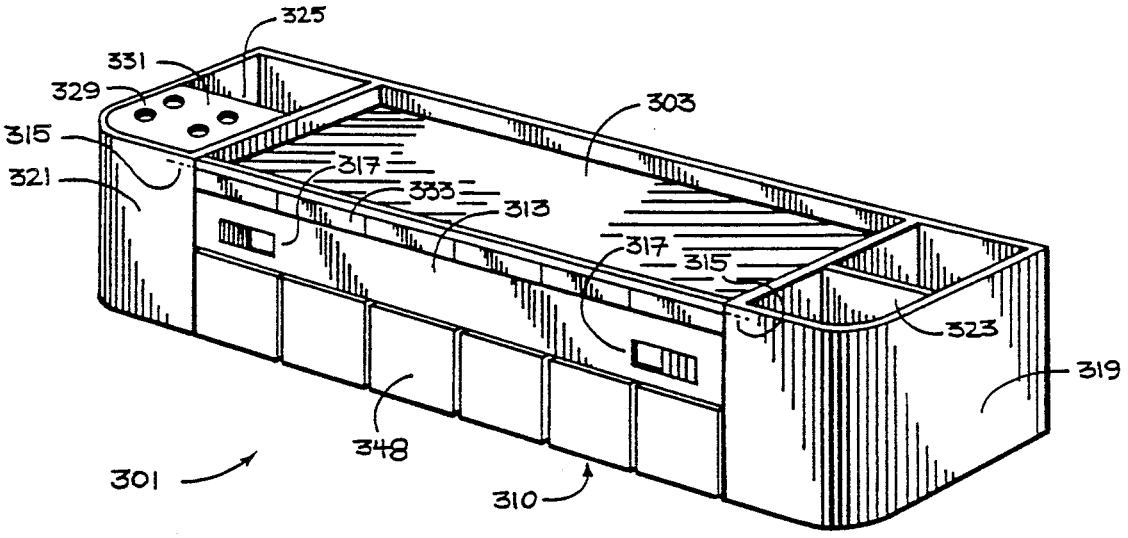
FIG.6.a.
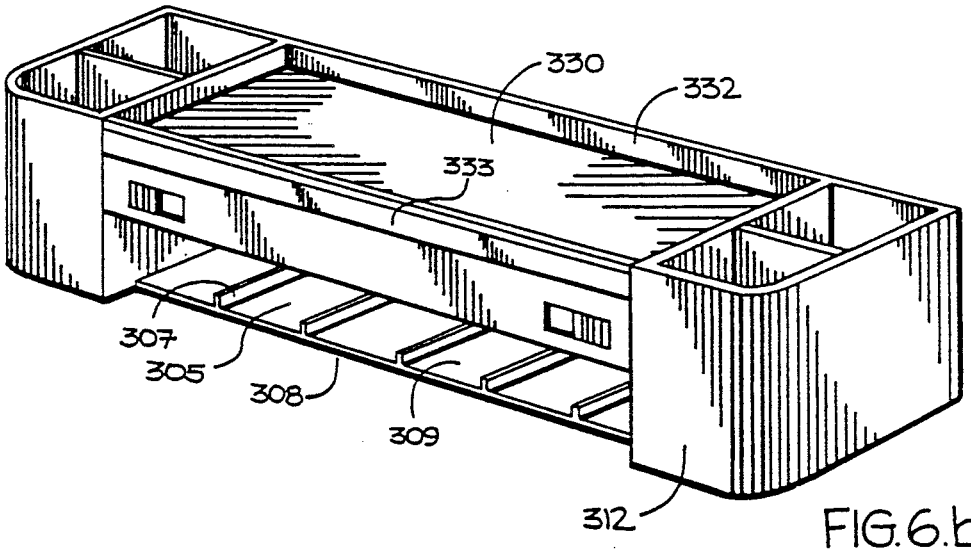
FIG.6.b.

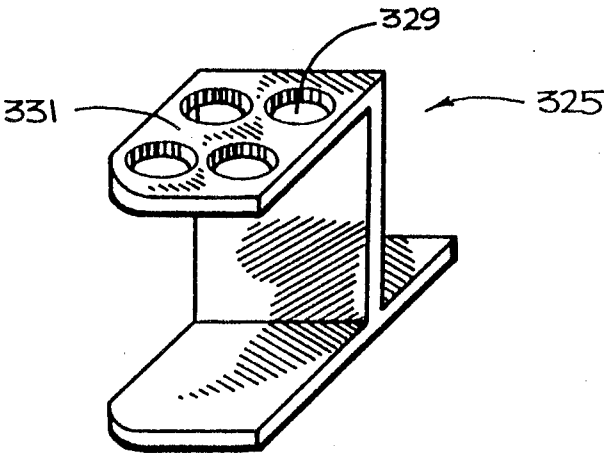
FIG. 7.b.
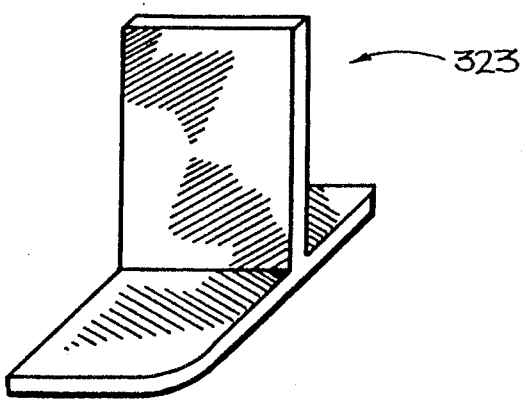
FIG. 7.a.

DISPENSING DEVICE AND A BATHROOM ORGANIZER INCORPORATING SAME

This invention relates to a means for dispensing a viscous material.

Product dispensers are well know, for example U.S. Pat. No. 2,718,335 to Shippen discloses a multiple dispenser that includes a plurality of containers for discharging dry materials, such as flour or spice, through openings in the bottom of the containers. The material is discharged through the force of gravity. Other references, such as U.S. Pat. No. 3,130,873 to Klutz, Jr. and U.S. Pat. No. 3,718,234 to Bagguley, teach multiple dispensers utilising a propellant to expel material retained in the dispensing containers.

Manually operated product dispensers are also known. For example U.S. Pat. No. 3,990,611 to Sojka discloses plural metering toiletry dispensers each in the nature of a displacement pump.

Known product dispensers do not combine the features of efficiency, convenience, hygiene, and the ability to be used with a variety of liquids having a wide viscosity range (such as liquid soap, hand lotion, shaving cream, after shave lotion, hair gel, and toothpaste) while avoiding the use of aerosols which may have an environmentally deleterious impact. Further, known multiple product dispensers do not maximize space utilisation in a bathroom environment nor avoid bathroom clutter resulting from toiletry accessories such as combs, brushes, hairpins, eyebrow pencils, toothbrushes and the like. Furthermore, many product dispensers are disposable which deleteriously impacts the environment. The present invention seeks to overcome some of these drawbacks.

Accordingly, the present invention comprises a dispensing means for a viscous material comprising: (a) a reservoir for containing a viscous material, said reservoir having a basal dispensing opening; (b) an air chamber; (c) a manual pumping means actuatable to pressurize air in said air chamber, said manual pumping means comprising a manually actuatable piston and urging means to urge said piston to an undepressed, unactuated position; (d) venting means for venting said air chamber to ambient air pressure prior to actuation of said pumping means comprising a one-way air chamber valve for opening to allow ambient air to enter said air chamber when the pressure in said air chamber is at or below ambient pressure and said one-way air chamber valve is free to open and for closing when the air pressure in said air chamber rises above ambient air pressure; (e) means for communicating pressurized air from said air chamber to said reservoir; (f) means for selectively blocking the dispensing of material through said basal dispensing opening comprising a leg depending from said piston and associated with said basal dispensing opening with said leg blocking the dispensing of material when said piston is undepressed, and said leg not blocking the dispensing of material when said piston is depressed; (g) a valve locking means for locking said valve closed, said valve locking means actuated by depressing said piston, sad valve locking means maintaining said valve closed during at least a portion of the return stroke of said piston; said manual pumping means being operatively connected to said means for selectively blocking the dispensing of material through said basal dispensing opening; whereby ambient air in said air chamber may be pressurized thereby communicating pressurised air to said reservoir so that when said reservoir contains viscous material and the dispensing of material is not blocked, viscous material at said basal dispensing opening is exposed to ambient air pressure so that viscous material in said reservoir is urged to exit through said basal dispensing opening by the pressure differential between the pressure in said reservoir and ambient air pressure and whereby after viscous material contained within said reservoir is dispensed through said basal dispensing opening and said piston is released and is returning to said undepressed position, pressure in said air chamber may fall below ambient air pressure while said one-way air chamber valve is locked closed so that while the dispensing of material through said basal dispensing opening is not blocked, material at said basal dispensing opening may be urged by a pressure differential to reenter said reservoir.

In another aspect, the present invention comprises a dispensing means for a viscous material comprising: (a) a reservoir for containing a viscous material, said reservoir having a basal dispensing opening; (b) an air chamber; (c) a manual pumping means actuatable to pressurize air in said air chamber; (d) venting means for venting said air chamber to ambient air pressure prior to actuation of said pumping means; (e) valved duct means for communicating pressurized air from said air chamber to said reservoir via a one-way non-return valve said duct means having a valve air inlet above the one-way non-return valve, said duct means incorporating said valve and said valve having a mouth communicating with said reservoir; said valve having a valve chamber and a reciprocatable valve element, said valve configured so as to provide a cavity between at least said valve air inlet portion and said mouth in order to trap a bubble of air in a portion of the cavity below the valve air inlet and above said mouth; (f) means for selectively blocking the dispensing of material through said basal dispensing opening; whereby ambient air in said air chamber may be pressurized in order to communicate pressurised air to said reservoir through said one-way air non-return valve so that when said reservoir contains viscous material and the dispensing of material is not blocked, viscous material at said basal dispensing opening is exposed to ambient air pressure so that viscous material in said reservoir is urged to exit through said basal dispensing opening by the pressure differential between the pressure in said reservoir and ambient air pressure and whereby repeated actuation of said pumping means may build up pressure in said reservoir due to said non-return valve and whereby air trapped in a portion of the cavity below the valve air inlet and above said mouth prevents reservoir fluid fouling said valve.

In a preferred form, the present invention provides a bathroom organiser comprising a plurality of such dispensing means as well as compartments, shelves, and pockets for other toiletry accessories.

In the figures which describe example embodiments of the invention;

Figure 2:
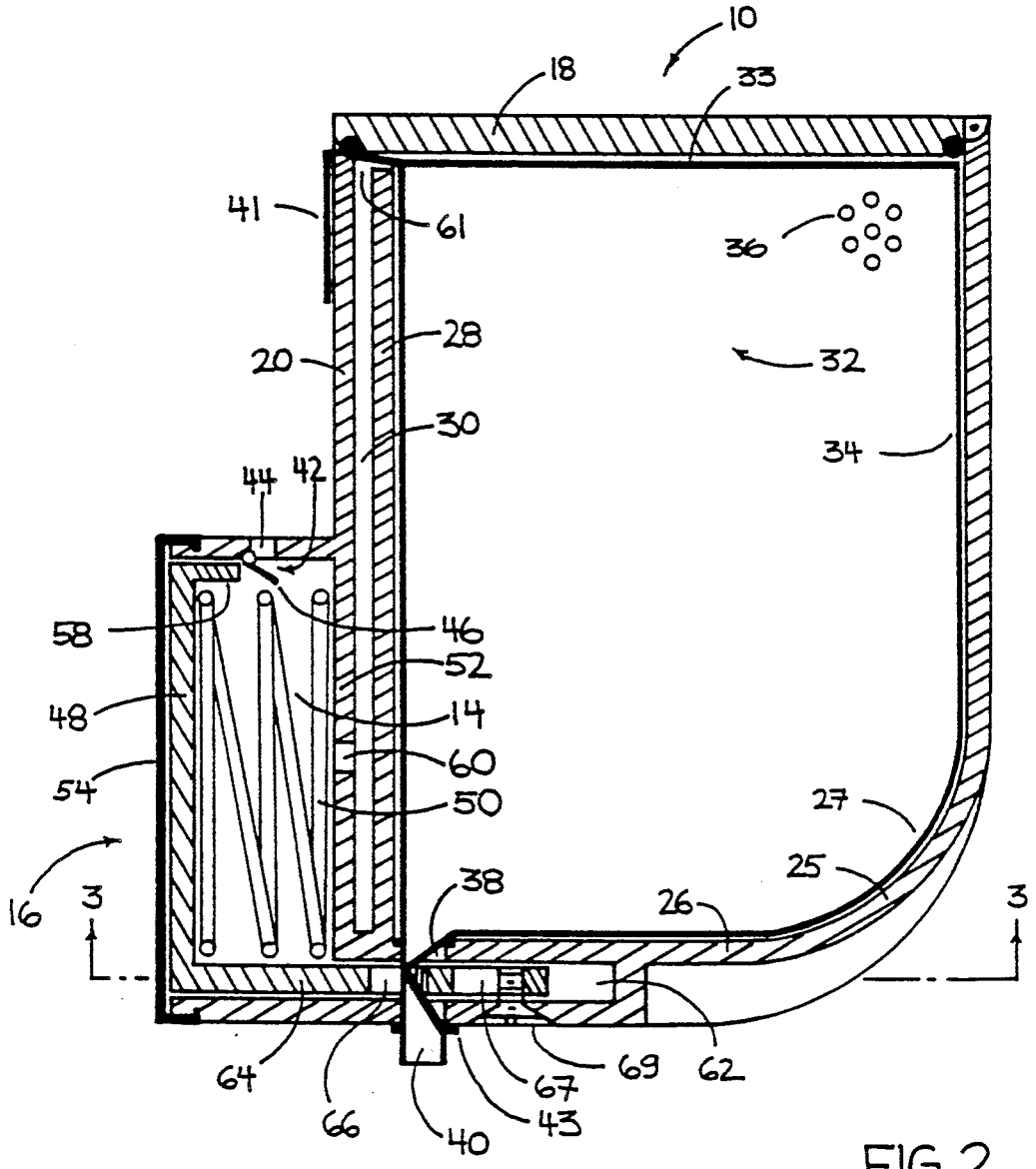
FIG. 2 is a sectional view of FIG. 1 along the plane defined by 2—2 of FIG. 1.
Figure 3:
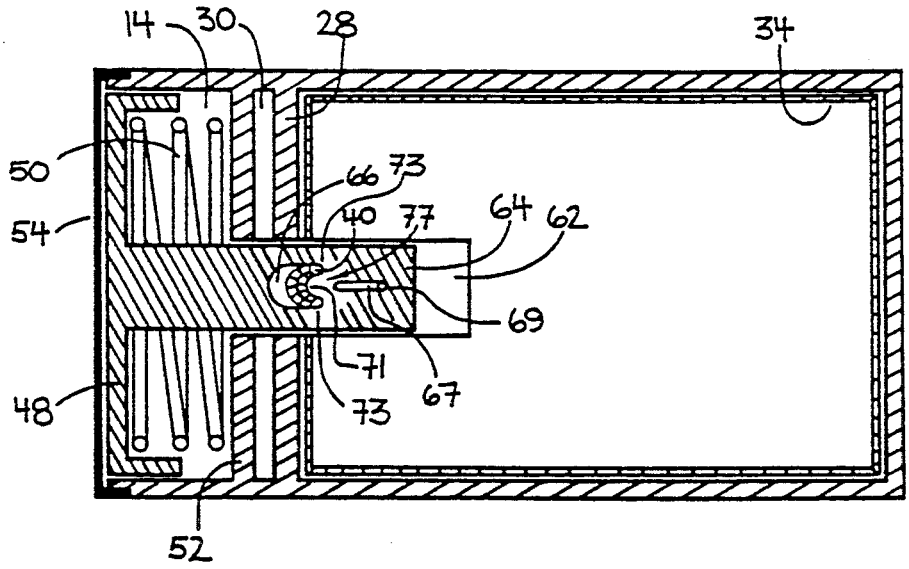
Figure 4:
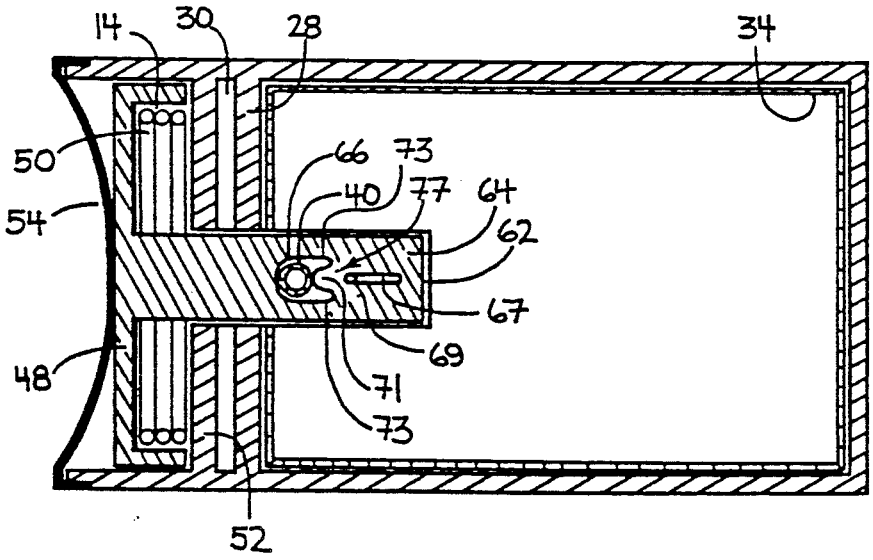
Figure 5:
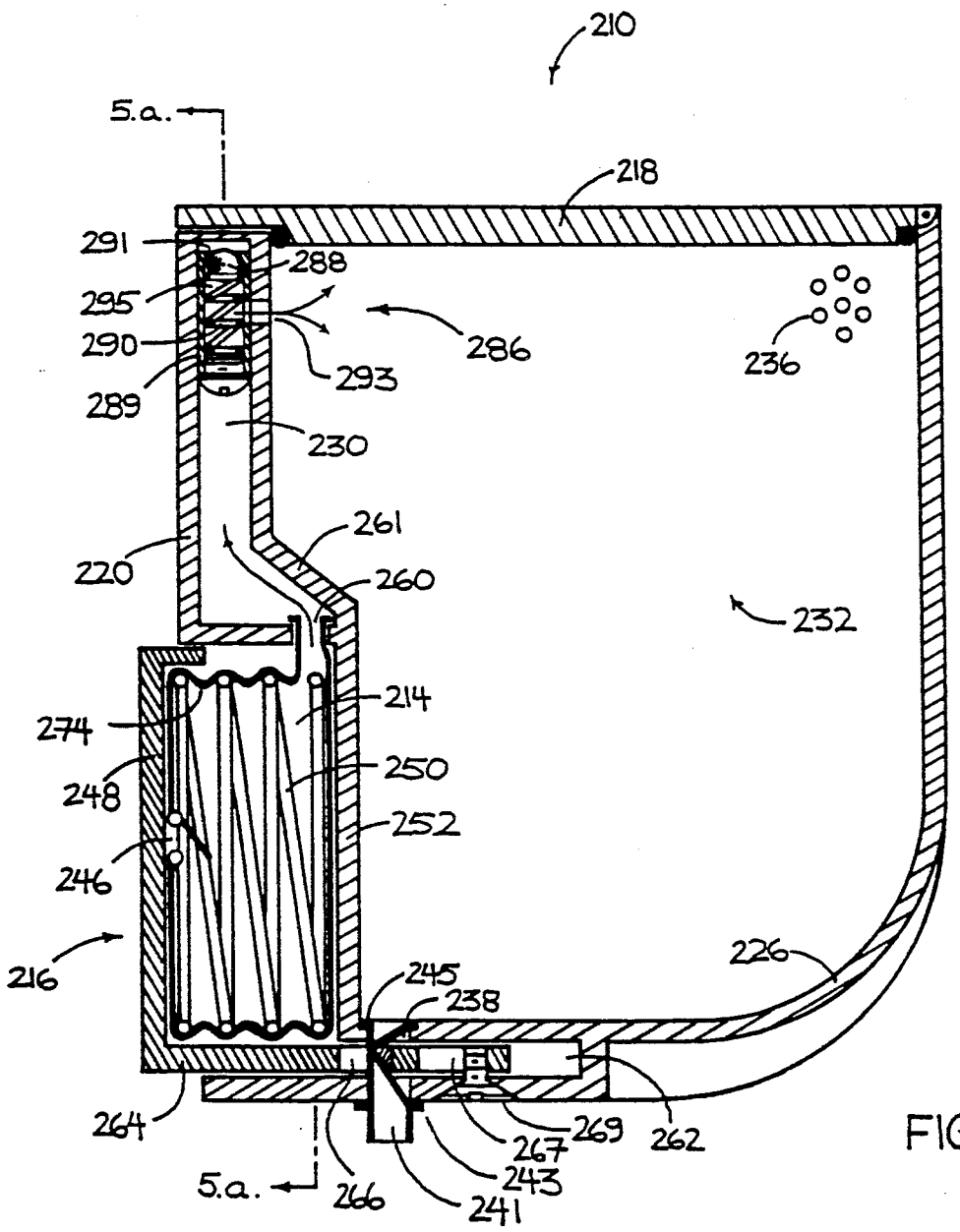

FIG. 2*a* is an enlarged view of a portion of FIG. 2;

FIG. 2*b* is a fragmentary front view of a portion of a sac utilisable in the dispensing unit of FIG. 2;

FIG. 3 is a sectional plan view through the line 3—3 of FIG. 2;

FIG. 4 is a sectional plan view of a dispensing unit made in accordance with this invention showing the unit in a dispensing mode;

FIG. 5 is side sectional view of another embodiment of a dispensing unit made in accordance with this invention;

FIG. 5*a* is a front view of FIG. 5;

FIG. 5*b* is a side sectional view of a modification of the dispensing unit of FIGS. 5 and 5*a*.

Figure 8:
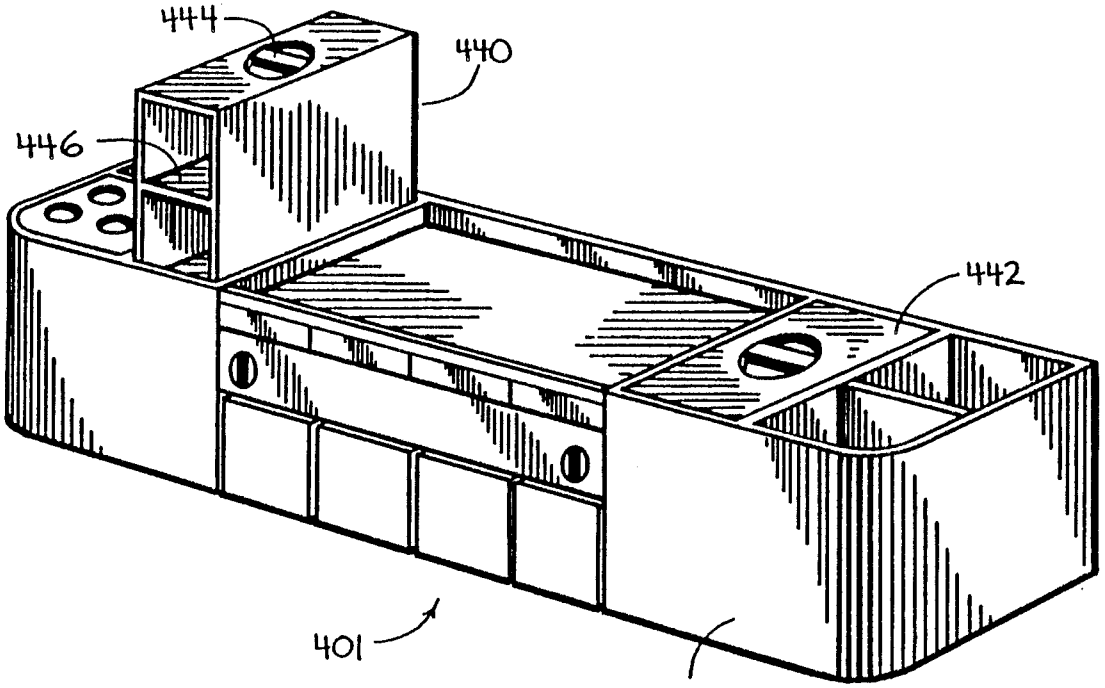

FIG. 6*a* is a perspective view of a bathroom organizer according to this invention;

FIG. 6*b* is a perspective view of the bathroom organizer of FIG. 6*a* with dispensing units removed;

FIGS. 7*a* and 7*b* are perspective views of a portion of FIGS. 6*a* and 6*b*; and FIG. 8 is a perspective view of an alternate embodiment of a bathroom organiser made in accordance with this invention.

Figure 1:
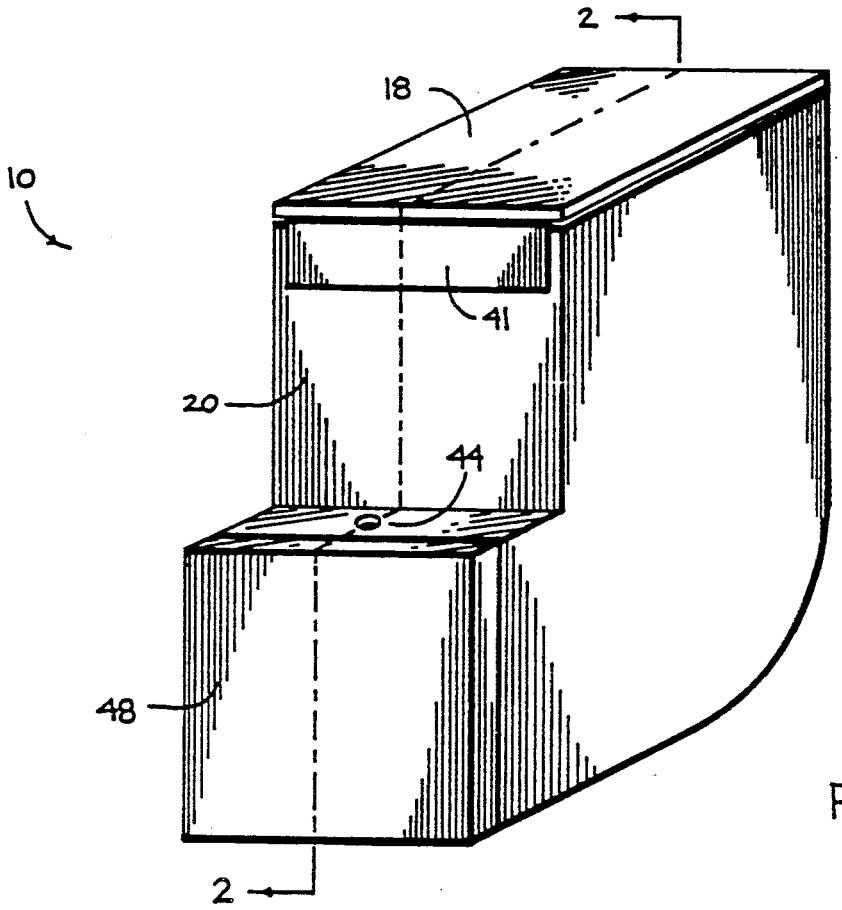
FIG. 1 is a perspective view of a dispensing unit made in accordance with this invention.

Referring to FIGS. 1, 2, and 2*a*, a dispensing unit indicated generally at 10 includes a reservoir 32 suitable for retaining a viscous material to be dispensed (such as liquid soap, hand lotion or the like), an air chamber 14, and a manual pumping means 16.

An air duct 30 extends from the air chamber 14 to proximate the reservoir's substantially air tight lid 18. The air duct 30 communicates with the air chamber 14 by way of passageway 60 and with the top of reservoir 32 through opening 61. The reservoir contains sac 34 filled with viscous material 36. The sac is dimensioned to leave a space 33 between the lid 18 and sac. An annular basal dispensing opening 38 in bottom wall 26 of the reservoir receives nozzle 40 of the sac 34. The bottom wall 26 of the reservoir may be sloped toward the basal dispensing opening 38 as indicated at 25 and the sac 34 may have a complimentarily sloped bottom 27. Additionally, although not shown, the sides of the dispensing unit may be sloped toward the basal dispensing opening. The sloping of the bottom and side walls of the reservoir toward the basal dispensing opening facilitate drainage. Nozzle 40 of the sac is made of a resilient material; the nozzle, when not deformed, is annular in shape. The sac has a tab 41 proximate its top which extends between the front wall 20 of the unit and lid 18 to outside of the unit. The front wall and lid sandwich the tab to retain it in position. The tab may have openings (not shown) along its width which are registered with opening 61 of air duct 30 when the tab is in position; these openings ensure the tab does not block the air duct.

Air chamber 14 has an air vent 42 comprising passageway 44 and one-way air valve 46 for allowing ambient air to pass into air chamber 14 when the one-way air valve 46 is open.

The manual pumping means comprises a piston (or plunger) 48 forming one wall of air chamber 14 so that the piston is in fluid communication with the air chamber 14. A spring 50 is positioned within air chamber 14 between piston 48 and the back wall 52 of the air chamber so as to urge piston 48 to the undepressed position shown in FIG. 2. A flexible airtight membrane 54 is secured over the piston. The top of the piston 48 comprises an arm 58 which slides over one-way valve 46 when the piston is depressed in order to lock the one-way valve closed. As best seen in FIG. 2*a*, a slot 62 in the bottom wall 26 of the reservoir extends from the front edge of the bottom wall to beyond the dispensing opening 38 in line with the dispensing opening. A slider (or leg) 64 depends from the bottom of the piston 48 and is slidably received within slot 62. Thus the slot functions as a slider guide. With reference to FIG. 3 as well as FIG. 2*a*, it is seen the slider 64 has a medial opening 66 which receives the nozzle 40 of sac 34. Opening 66 has a back edge 77 which comprises a medial concave semi-circular portion 71 formed by wedge shaped tang 75 of the slider and convex wings 73 on either side of the concave semi-circular portion. As will be described hereinafter, back edge 77 functions as a nozzle pinching edge. The slider has a slot 67 which receives a set screw 69 threaded into the base 26 of the reservoir; slot 67 and set screw 69 prevent the withdrawal of the slider from slot 62 in the base 26 of the reservoir.

As seen in FIG. 2*b*, nozzle 40 of sac 34 has a convex external retainer ring 80. The sac 34 initially has a removable pin 84 threaded into nozzle 40. The pin is rigid and has a circumferential restriction 86 which is in registration with the external retaining ring and a tapered head 88.

In operation, lid 18 may be opened and a sac 34 inserted into reservoir 32. It will be noted that the slope 27 of the bottom wall of the sac facilitates proper orientation of the sac and nozzle in the reservoir. As the sac is lowered into the reservoir, the plunger 48 is depressed to align the slider opening 66 with the basal dispensing opening 38 and the nozzle 40 of the sac may then be inserted and pulled through the basal dispensing opening until the external nozzle retainer ring 80 snaps past the bottom of the basal dispensing opening in order to retain the nozzle 40 in position. The circumferential restriction 86 in the pin accommodates a portion of the retaining ring 80 of the nozzle as the ring 80 is compressed by the lip of the basal dispensing opening 38 during insertion. The tapered head 88 of the pin facilitates the aligning of the nozzle 40 with the basal dispensing opening 38 and the rigidity of the pin stiffens the nozzle so that the nozzle may be readily inserted into and pulled through the basal dispensing opening. After the sac has been properly inserted (and the nozzle snapped into position in the basal dispensing opening), the plunger may be released and the removable pin 84 removed. The back half of external retainer ring 80 may be thicker than the front half in order that the nozzle 40 is canted forward toward the front of the dispensing unit when the nozzle has been snapped into place.

When piston 48 is in an undepressed position as shown in FIGS. 2, 2*a*, and 3, one-way valve 46 is open and the air pressure in the air chamber is at ambient pressure. As a result of air passageway 60, air duct 30, and air space 33, the pressure over the top surface of the sac 34 is also ambient. In the undepressed position, slider 64 of piston 48 is positioned so that the back edge 77 of opening 66 pinches resilient nozzle 40 of sac 34 closed against the front edge of the basal dispensing opening 38; this blocks the dispensing of material through the basal dispensing opening. Since this nozzle pinching back edge 77 of slider opening 66 has a concave semi-circular middle 71 and convex wings 73, the nozzle pinching edge pinches the nozzle into a crescent moon shape which ensures the nozzle is completely pinched closed.

As piston 48 is depressed against the resistance of spring 50, the pressure in the air chamber 14 begins to rise (due to the fact air may only exit the air chamber through the narrow passageway 44). This increase in air chamber pressure closes the one-way air valve 46 so that, as the piston 48 continues to be depressed, the air pressure in air chamber 14 increases and pressurised air is communicated to space 33 at the top of the reservoir sac 34 through passageway 60 and air duct 30. It should be noted that at a certain point in the stroke of the piston, the piston arm 58 slides over one-way air valve 46 thereby locking the valve in a closed position. Furthermore, as piston 48 is depressed, opening 66 in slider 64 moves into alignment with basal dispensing opening 38 thereby allowing resilient nozzle 40 of sac 34 to open to its undeformed annular shape.

In consequence, when piston 48 is depressed, there is a higher than ambient air pressure exerted upon the top surface of the reservoir sac 34 and the material therein and ambient pressure exerted on the material in the reservoir sac at the basal dispensing opening; this pressure differential urges material to dispense through the nozzle 40.

As material is dispensed, the volume of the space 33 in the top of reservoir 32 expands, and this, in and of itself, would reduce the air pressure exerted upon the top surface of the reservoir sac 34. (Since, however, depression of the piston acts to increase pressure, the net effect, while the piston continues to be depressed, may be otherwise.)

When piston 48 is released, spring 50 acts against back wall 52 to urge the piston towards the undepressed position shown in FIG. 2 thereby increasing the volume of the air chamber and hence reducing the air pressure within the air chamber (and thus within the space 33 above the reservoir 32). During the return stroke of the piston, the semi-circular portion 71 of the nozzle pinching edge 77 first contacts and then increasingly deforms resilient nozzle 40 toward a crescent moon shape as the semi-circular edge portion pinches the nozzle against the edge of the basal dispensing opening 38 and the convex wings 73 of the nozzle pinching edge receive the tips of the forming crescent moon shape. In this way the nozzle is increasingly restricted. Arm 50 locks one-way valve 46 in a closed position for a portion of the return stroke of the piston. Consequently, if sufficient material has been dispensed during the stroke of the piston, the air pressure in air chamber 14 will fall below ambient at some point during the return stroke of the piston while the one-way valve is locked closed. If the air pressure in the air chamber (and, hence, in space 33) falls below ambient while nozzle 40 remains partially unrestricted, a pressure differential results which exerts a force on any material remaining in the nozzle, thereby urging it to re-enter the reservoir 32. The magnitude of this force is dependent upon the magnitude of the pressure differential. Such a force will continue to be exerted upon material in the nozzle for as long as a pressure differential exists and the nozzle 40 remains partially unrestricted.

This force acting on any material remaining in the nozzle 40 disappears when either the nozzle 40 becomes completely restricted or the piston arm 58 ceases to lock the one-way air valve 46 so that the valve opens.

Once the pressure in the air chamber has dropped to or below ambient pressure and arm 58 ceases to lock air-valve 46, one-way air valve 46 opens so that the air pressure in air chamber 14 builds to ambient pressure. Accordingly, the air pressure in air duct 30 and in space 33 atop air reservoir 32 will also build to ambient air pressure. When the piston reaches the undepressed position, resilient nozzle 40 will be pinched closed between tang 75 and the edge of basal dispensing opening 38, completely preventing movement of material through nozzle 40.

As the viscous material in sac 34 is depleted, the sac crumples, however, tab 41 and retaining ring 80 maintain the front wall 34*a* of the sac taut. This facilitates drainage of the viscous material from the sac. Additionally, when this material is exhausted, the tab facilitates removal of the sac after lid 18 of the reservoir is opened.

In the embodiment of FIG. 5 and FIG. 5*a*, a dispensing unit indicated generally at 210 includes a reservoir 232 containing a viscous material 236, an air chamber 214, and a manual pumping means 216.

The reservoir 232 has a hinged air tight lid 218 and a bottom wall 226. A basal dispensing opening 238 in bottom wall 226 is fitted with a resilient nozzle 241; nozzle 241 is retained in position by snap rings 243 and 245.

The manual pumping means comprises a piston 248 which abuts one side of bellows 274 lining air chamber 214. Bellows 274 also has a one-way air intake valve 246 for allowing ambient air to pass into air chamber 214 when one-way valve 246 is open. A spring 250 is positioned within air chamber 214 between back wall 252 of air chamber 214 and the piston 248, so as to urge piston 248 to the undepressed position shown in FIG. 5.

Air duct 230 extends from the top of the air chamber 214 to proximate the top of reservoir 232 and a passageway 260 connects the air chamber with the air duct. The top portion of air duct 230 turns back on itself to form a valve air inlet portion. This duct portion incorporates a ball valve 286 and terminates in a mouth 293. The ball valve comprises a valve chamber 289 containing a ball 288 which has a clearance fit within the chamber and is urged into a ball seat 291 by spring 290. The valve chamber 289 terminates at mouth 294; consequently, the valve chamber extends below the ball when the ball is seated, as shown in FIG. 5. Thus, there is a cavity 295 between the ball 289 and the mouth 293 of the valve when the ball is seated which traps a pocket of air in a portion of the cavity below the valve air inlet and above the mouth 293 when the reservoir is filled with a viscous material 236. The ball valve allows pressurized air to pass from the air duct into the reservoir 232 while preventing viscous fluid or air in the reservoir from flowing into the air duct.

A slot 262 in the bottom wall 226 of the reservoir extends from the front edge of the bottom wall to beyond the dispensing opening 238 in line with the dispensing opening 238. A slider 264 depending from the bottom of piston 248 is slidably received within slot 262. Slider 264 has an opening 266 which receives nozzle 241.

In operation, when piston 248 is in an undepressed position as shown in FIG. 5, one-way air valve 246 is open and the air pressure in air chamber 214 is ambient. In the undepressed position, slider 264 of piston 248 pinches nozzle 241 closed between the back edge of opening 266 and the front edge of the basal dispensing opening 238. (It is noted that opening 266 may have the configuration of opening 66 of FIG. 3.)

As piston 248 is depressed against the resistance of spring 250, the air pressure in air chamber 214 increases, thereby closing, one-way air valve 246. As piston 248 continues to be depressed, the air pressure in air chamber 214 continues to increase and this increased air pressure, if greater than the back pressure in the reservoir 232 (ignoring the minor additional pressure needed to overcome the resistance of the spring of the ball valve), opens one-way ball valve 286 so that pressurised air is communicated to the reservoir. Because of the clearance fit of the ball within the valve chamber and the biasing force of spring 290, ball 289 only moves just clear of its seat when air is pumped through the valve. This ensures that air in a portion of the cavity 295 below the valve air inlet and above the mouth 293 is maintained during the pumping of air through the valve so that there is a trapped pocket of air in this cavity at all times. Furthermore, as piston 248 is depressed, the opening in slider 264 moves into alignment with basal dispensing opening 238 thereby allowing resilient nozzle 241 to open.

In consequence, when piston 248 is depressed, the viscous material in the reservoir will be at a higher than ambient air pressure whereas ambient air pressure will be exerted upon the material at the nozzle 241, thus creating a pressure differential. This pressure differential urges the viscous material through nozzle 241.

As piston 248 is released, spring 250 urges piston 248 towards the undepressed position of FIG. 5, thereby increasing the volume of air chamber 214 and thus reducing the air pressure in air chamber 214 and duct 230. However, the pressure in the reservoir is maintained due to one-way ball valve 286. Material may therefore continue to be dispensed through nozzle 241 as a result of any pressure differential between pressure in the reservoir and ambient pressure until resilient nozzle 241 is pinched closed.

Once pressure in air chamber 214 drops to ambient pressure, one-way air valve 246 opens.

As a result of the one-way ball valve 286, pressure in the reservoir is only reduced by the dispensing of material through nozzle 241. Consequently, it is possible to pump up the pressure in the reservoir to significantly above ambient pressure, as follows. Depending upon the viscosity of the material 236, the pressure developed in the reservoir during a stroke of the piston 248 may be insufficient for sufficient material to be discharged from the reservoir to reduce the pressure in the reservoir 232 to ambient in the time period during which the nozzle is open. In such circumstances, when the nozzle re-closes, the air pressure in the reservoir will remain above ambient. Accordingly, when piston 248 is again depressed, the air pressure in the reservoir 232 is further increased, limited only by the maximum air pressure that can be developed within air chamber 214. By being able to pump up the air pressure in the reservoir, it may be possible to dispense high viscosity materials through nozzle 241.

The trapped air in a portion of the cavity 295 is a bubble between the valve air inlet and the mouth 293 which presents a barrier to the reservoir fluid thus preventing it from fouling the ball valve.

Optionally, passageway 260 may have a one-way valve therein in addition to, or in place of, ball valve 286.

If the mouth 293 of the valve is proximate at the top of the air duct 230 and if the nozzle 241 is removed from the basal dispensing opening 238, the dispensing unit of FIG. 5 may be used with a sac of viscous material such as described in connection with FIGS. 1 through 4. Thus, it will be seen that the FIG. 5 dispensing unit may be dual purpose, that is, a viscous fluid may be added directly to the reservoir of the FIG. 5 dispensing unit or a sac of viscous fluid may be placed in the reservoir. FIG. 5*b* illustrates a dispensing unit 210*b* similar to the FIG. 5 dispensing unit (with like reference numerals designating like parts) with nozzle 241 (of FIG. 5) removed and a sac 234 in place. It will be noted that a sac used in the reservoir of FIG. 5 may have downwardly sloping upper front portion following sloping wall 261 to facilitate drainage towards the basal dispensing opening.

If the dispensing unit 10 of FIGS. 1 through 4 is modified to incorporate a one-way non-return valve in duct 30, the unit may be used without a sac 32 by fitting a nozzle of the type utilised in connection with the dispensing unit 210 of FIG. 5 to the basal dispensing opening 38 of the reservoir 32 with retaining rings and by thereafter adding viscous fluid directly to the reservoir.

Referring to FIGS. 6*a* and 6*b*, a bathroom organizer indicated generally at 301 comprises a housing 303 divided into a plurality of compartments 305 with each compartment holding a dispensing unit 310 of the type described in connection with FIGS. 1 through 5 such that the nozzle of each dispensing unit is positioned forwardly of the front edge 308 of the bottom wall 309 of the housing and protrudes below the bottom wall of the housing.

The compartments 305 are defined by the walls of the housing and by dividers 307. The front edge 308 of the bottom wall 309 of the housing is recessed from the front surface 312 of the housing. The housing 303 also has a door 313 hinged at hinges 315 proximate the front surface of the housing. The door has locks 317. When locks 317 are disengaged, door 313 may be opened about hinges 315 so that any dispensing unit may be removed from the housing and another dispensing unit inserted into the unoccupied compartment. The sloped portion (25 of FIG. 2) of the bottom wall of the dispensing units facilitates insertion and withdrawal of the units. When all dispensing units are seated properly in their compartments, door 313 may be closed and locks 317 engaged to secure the dispensing units within the housing. The door may have a resilient bumper on its inside surface which abuts the dispensing units when the door is locked closed in order to securely hold the units.

Viscous material may be dispensed from any of the individual dispensing units 310 secured within the housing 303 by depressing the plunger 348 which is part of the dispensing unit. When the organiser is wall mounted, torque on the organiser is minimised during dispensing by the fact that the plungers of the dispensing units are depressed toward the mounting wall.

The housing 303 terminates at either end in end pockets 319 and 321. End pocket 319 contains a removable insert 323 shown in FIG. 7*a* and end pocket 321 contains a removable insert 325 shown in FIG. 7*b*. Insert 325 has a plurality of openings 329 through its top plate 331. With inserts 323 and 325 received within end pockets 319 and 321 respectively, the end pockets are suitable for holding many of the items normally used in a bathroom environment. The fact that inserts 323 and 325 can be removed facilitates the convenient cleaning of the end pockets 319 and 321. Optionally, the end pockets themselves may be removable from the organiser.

The top of the housing comprises a shelf 330 with a raised rim 332 surrounding the sides and back thereof. Further, the top of the door extends above the level of the shelf 330 to form a rim along the front of the shelf.

The dispensing units may have a description of their contents on the front surface of wall 20 (see FIG. 1) of the unit or, alternatively, the tab 41 (see FIG. 1) which is part of a reservoir sac may have a description of its contents written thereon. Door 313 of the bathroom organiser may have a transparent magnifying strip 333 across its front so that the contents description appearing on each dispensing unit (or on the tabs 41) in the organiser is visible through, and is magnified by, the strip.

A modified bathroom organiser 401 is illustrated in FIG. 8. Bathroom organiser 401 includes vertical drawers 440 and 442 each having a frontal opening 446. A finger grip 444 in the top of each drawer allows withdrawal of the drawers from the housing 403.

The dispensing units of the bathroom organiser could be integrally formed therewith.

The bathroom organiser may have attachment means in its back wall for fastening to a vertical wall or in its bottom wall for fastening to a horizontal shelf.

Other modifications and variations within the spirit of this invention will be apparent to those skilled in the art.

I claim:

1. A dispensing means for a viscous material comprising:

(a) a reservoir for containing a viscous material, said reservoir having a basal dispensing opening;

(b) an air chamber;

(c) a manual pumping means actuatable to pressurize air in said air chamber, said manual pumping means comprising a manually actuatable piston and urging means to urge said piston to an undepressed, unactuated position;

(d) venting means for venting said air chamber to ambient air pressure prior to actuation of said pumping means comprising a one-way air chamber valve for opening to allow ambient air to enter said air chamber when the pressure in said air chamber is at or below ambient pressure and said one-way air chamber valve is free to open and for closing when the air pressure in said air chamber rises above ambient air pressure;

(e) means for communicating pressurized air from said air chamber to said reservoir;

(f) means for selectively blocking the dispensing of material through said basal dispensing opening comprising a leg depending from said piston and associated with said basal dispensing opening with said leg blocking the dispensing of material when said piston is undepressed, and said leg not blocking the dispensing of material when said piston is depressed;

(g) a valve locking means for locking said valve closed, said valve locking means actuated by depressing said piston, said valve locking means maintaining said valve closed during at least a portion of the return stroke of said piston;

said manual pumping means being operatively connected to said means for selectively blocking the dispensing of material through said basal dispensing opening;

whereby ambient air in said air chamber may be pressurized thereby communicating pressurised air to said reservoir so that when said reservoir contains a viscous material and the dispensing of material is not blocked, viscous material at said based dispensing opening is exposed to ambient air pressure so that viscous material in said reservoir is urged to exit through said basal dispensing opening by the pressure differential between the pressure in said reservoir and ambient air pressure and whereby after viscous material contained within said reservoir is dispensed through said basal dispensing opening and said piston is released and is returning to said undepressed position, pressure in said air chamber may fall below ambient air pressure while said one-way air chamber valve is locked closed so that while the dispensing of material through said basal dispensing opening is not blocked, material at said basal dispensing opening maybe used by a pressure differential to re-enter said reservoir.

2. The dispensing means of claim 1 wherein said valve locking means comprises an arm depending from said piston for holding said air chamber valve in a closed position when said piston is depressed.

3. A dispensing means for a viscous material comprising:

(a) a reservoir for containing a viscous material, said reservoir having a basal dispensing opening;

(b) an air chamber;

(c) a manual pumping means actuatable to pressurize air in said air chamber, said manual pumping means comprising a manually actuatable piston and urging means to urge said piston to an undepressed, unactuated position;

(d) venting means for venting said air chamber to ambient air pressure prior to actuation of said pumping means comprising a one-way air chamber valve for opening to allow ambient air to enter said air chamber when the pressure in said air chamber is at or below ambient pressure and said one-way air chamber valve is free to open and for closing when the air pressure in said air chamber rises above ambient air pressure;

(e) means for communicating pressurized air from said air chamber to said reservoir;

(f) means for selectively blocking the dispensing of material through said basal dispensing opening comprising a nozzle received by said basal dispensing opening in fluid communication with said reservoir; a slider depending from said piston for closing said nozzle when said piston is in a first position and for opening said nozzle when said piston is depressed to a second position; and a slider guide for guiding said slider;

said manual pumping means being operatively connected to said means for selectively blocking the dispensing of material through said basal dispensing opening;

(g) a valve locking means for locking said valve closed, said valve locking means actuated by depressed said piston, said valve locking means maintaining said valve closed during at least a portion of the return stroke of said piston;

whereby ambient air in said air chamber may be pressurized thereby communicating pressurised air to said reservoir so that when said reservoir contains viscous material and the dispensing of material is not blocked, viscous material at said basal dispensing opening is exposed to ambient air pressure so that viscous material in said reservoir is urged to exit through said basal dispensing opening by the pressure differential between the pressure in said reservoir and ambient air pressure and whereby when said piston is in said first position, said slider blocks the discharge of material contained in said reservoir through said nozzle, and when said piston is depressed to said second position, material retained in said reservoir may be discharged through said nozzle and whereby after viscous material contained within said reservoir is dispensed through said basal dispensing opening and said piston is released and is returning to said undepressed position, pressure in said air chamber may fall below ambient air pressure while said one-way air chamber valve is locked closed so that while the dispensing of material through said basal dispensing opening is not blocked, material at said basal dispensing opening may be urged by a pressure differential to re-enter said reservoir.

4. The dispensing means of claim 3 wherein said valve locking means comprises an arm depending from said piston for holding said air chamber valve in a closed position when said piston is depressed.

5. A dispensing means for a viscous material comprising:

(a) a reservoir for containing a viscous material, said reservoir having a basal dispensing opening;

(b) an air chamber;

(c) a manual pumping means actuatable to pressurize air in said air chamber;

(d) venting means for venting said air chamber to ambient air pressure prior to actuation of said pump means;

(e) valved duct means for communicating pressurized air from said air chamber to said reservoir via a one-way non-return valve, said duct means having a valve air inlet portion above the one-way non-return valve, said duct means incorporating said valve, and said valve having a mouth communicating with said reservoir; said valve having a valve chamber and a reciprocatable valve element, said valve configured so as to provide a cavity between at least said valve air inlet portion and said mouth in order to trap a bubble of air in a portion of said cavity below said air inlet and above said mouth;

(f) means for selectively blocking the dispensing of material through said basal dispensing opening; whereby ambient air in said air chamber may be pressurized in order to communicate pressurised air to said reservoir through said one-way air non-return valve so that when said reservoir contains viscous material and the dispensing of material is not blocked, viscous material at said basal dispensing opening is exposed to ambient air pressure so that viscous material in said reservoir is urged to exit through said basal dispensing opening by the pressure differential between the pressure in said reservoir and ambient air pressure and whereby repeated actuation of said pumping means may build up pressure in said reservoir due to said non-return valve and whereby air trapped below said valve air inlet portion and above said mouth prevents reservoir fluid fouling said valve.

6. The dispensing means of claim 5 wherein said manual pumping means is operatively connected to said means for selectively blocking the dispensing of material through said basal dispensing opening.

7. The dispensing means of claim 5 wherein said manual pumping means comprises a manually actuatable piston and urging means to urge said piston to an undepressed, unactuated position.

8. The dispensing means of claim 7 wherein said means for selectively blocking the dispensing of reservoir material through said basal dispensing opening comprises a leg depending from said piston and associated with said basal dispensing opening, said leg blocking the dispensing of material through said basal dispensing opening when said piston is undepressed and said leg not blocking the dispensing of material through said basal dispensing opening when said piston is depressed.

9. The dispensing means of claim 8 wherein said means for selectively blocking the dispensing of reservoir material through said basal dispensing opening includes a nozzle received by said basal dispensing opening and communicating with said reservoir, said leg for closing said nozzle when said piston is undepressed to thereby block the dispensing of material from said reservoir.

10. The dispensing means of claim 9 wherein said nozzle is resilient and annular, said basal dispensing opening is annular, said leg comprises an opening receiving said nozzle, said leg opening having a nozzle pinching edge for pinching said nozzle closed against the edge of said basal dispensing opening, said nozzle pinching edge formed by a wedge-shaped tang and having a medial concave semi-circular portion with a convex wing on either side thereof whereby, when said piston moves toward said undepressed position, said concave semi-circular portion of said nozzle pinching edge first contacts and then progressively deforms said nozzle toward a crescent moon shape, with said convex wings accomodating the tips of the forming crescent moon shape, said wedge-shaped tang facilitating the deformation of said nozzle.

11. The dispensing means of claim 9 wherein said dispensing means includes a viscous material containing sac, said sac having a tab extending out of said reservoir so as to be visible from the outside of said dispensing means and retained by tab retaining means whereby said tab may contain information on the contents of said sac and may assist in complete drainage and removal of said sac once spent.

12. The dispensing means of claim 5 wherein means for selectively blocking the dispensing of reservoir material through said basal dispensing opening comprises;

(a) a nozzle received by said basal dispensing opening in fluid communication with said reservoir;

(b) a slider depending from said piston for closing said nozzle when said piston is in a first position and for opening said nozzle when said piston is depressed to a second position;

(c) a slider guide for guiding said slider; whereby when said piston is in said first position, said slider blocks the discharge of material contained in said reservoir through said nozzle, and when said piston is depressed to said second position, material retained in said reservoir may be discharged through said nozzle.

13. A bathroom organizer and product dispenser comprising:

(a) a housing divided into a plurality of separate compartments, each compartment including a frontal opening and a basal opening;

(b) a plurality of dispensing units, each of said dispensing units housed by one of said separate compartments and each of said dispensing units comprising:

i. a reservoir for containing a viscous material, said reservoir having a basal dispensing opening which receives a nozzle which is in fluid communication with said reservoir, and said nozzle received in the basal opening of one of said plurality of compartments;

ii. an air chamber;

iii. manual pumping means comprising a manually actuatable piston and urging means to urge said piston to an undepressed, unactuated position, said piston received in the frontal opening of the compartment receiving the dispensing unit;

iv. venting means for venting said air chamber to ambient air pressure when said piston is in said undepressed, unactuated position;

v. means for communicating pressurized air from said air chamber to said reservoir;

vi. a leg depending from said piston and associated with said basal dispensing opening with said leg blocking the dispensing of material when said piston is undepressed, and said leg not blocking the dispensing of material when said piston is depressed whereby ambient air in said air chamber may be pressurized thereby communicating pressurised air to said reservoir so that when said reservoir contains viscous material and the dispensing of material is not blocked, viscous material at said basal dispensing opening is exposed to ambient air pressure so that viscous material in said reservoir is urged to exit through said basal dispensing opening by the pressure differential between the pressure in said reservoir and ambient air pressure;

(c) means for releasably retaining each of said plurality of dispensing units within said housing; and (d) at least one end pocket, each end pocket including a removable insert for permitting each said end pocket to receive items used in a bathroom; said removable insert being a vertically opening drawer having a frontal opening and an apical finger grip.

* * * * *

UNITED STATES PATENT AND TRADEMARK OFFICE

CERTIFICATE OF CORRECTION

PATENT NO. : 5,115,945

DATED : May 26, 1992

INVENTOR(S) : Wolf E. Ruck

It is certified that error appears in the above-identified patent and that said Letters Patent is hereby corrected as shown below:

Col. 1, line 62, change "sad" to read --said--.

Col. 6, line 33, change "294" to read --293--.

Col. 10, line 7, change "may be used" to read --may be urged--;
and lines 48-49, change "depressed" to read --depressing--.

Col. 11, line 22, change "pump" to read --pumping--.

Signed and Sealed this

Tenth Day of January, 1995

Bruce Lehman

*Attest:*

BRUCE LEHMAN

*Attesting Officer*

*Commissioner of Patents and Trademarks*